US005528901A

United States Patent [19]

Willis

[11] Patent Number: 5,528,901

[45] Date of Patent: Jun. 25, 1996

[54] COMPACT AUXILIARY POWER SYSTEM FOR HEAVY-DUTY DIESEL ENGINES AND METHOD

[75] Inventor: Guy E. Willis, Reno, Nev.

[73] Assignee: Auxiliary Power Dynamics, Inc., Reno, Nev.

[21] Appl. No.: 416,319

[22] Filed: Apr. 4, 1995

Related U.S. Application Data

[63] Continuation-in-part of Ser. No. 203,414, Mar. 1, 1994.

[51] Int. Cl.[6] ..... F02B 73/00; F02N 15/00; F02N 9/04

[52] U.S. Cl. ..... 60/626; 60/698; 60/708; 123/179.31; 123/142.5 R; 123/179.19; 123/DIG. 8

[58] Field of Search ..... 60/698, 706, 708, 60/625, 626; 123/179.31, 142.5 R, 179.19, DIG. 8

[56] References Cited

U.S. PATENT DOCUMENTS

| | | | |
|---|---|---|---|
| 1,618,335 | 2/1927 | Hefti | 60/626 |
| 2,557,933 | 6/1951 | Beaman et al. | 60/629 |
| 2,696,203 | 12/1954 | Nallinger | 123/179.19 |
| 2,766,749 | 10/1956 | Stegemann | 123/179.19 |
| 2,906,088 | 9/1959 | Clark | 60/626 |
| 2,943,617 | 7/1960 | Zuhn | 123/179.19 |
| 3,156,229 | 11/1964 | Manning | 123/179.31 |
| 3,662,544 | 5/1972 | Kahn et al. | 60/39.142 |
| 3,744,602 | 7/1973 | Ajwani | 123/179.31 |
| 4,248,190 | 2/1981 | Grigsby | 123/179.31 |
| 4,448,157 | 5/1984 | Eckstein et al. | 123/142.5 R |
| 4,513,379 | 7/1985 | Diefenthaler, Jr. | 60/714 |
| 4,542,722 | 9/1985 | Reynolds | 123/179.19 |
| 4,611,466 | 9/1986 | Keedy | 60/714 |
| 4,682,649 | 7/1987 | Greer | 165/43 |
| 4,756,359 | 7/1988 | Greer | 165/43 |

*Primary Examiner*—Leonard E. Heyman
*Attorney, Agent, or Firm*—Flehr, Hohbach, Test, Albritton & Herbert

[57] ABSTRACT

An auxiliary power assembly (5) for use with a heavy-duty diesel engine (8) of the type used in the trucking industry and including a small auxiliary diesel engine (9), an air compressor (10), a compressed air accumulator (17) fluid coupled to the air compressor (10), and a pneumatic starter (21) fluid coupled to the accumulator (17) and mechanically coupled to start the heavy-duty diesel engine (8). The auxiliary power assembly (5) further drives: a coolant pump (51) connected to circulate coolant between the auxiliary engine (9) and main diesel engine (8), a refrigerant compressor (41) formed to pump air conditioning fluid from the main diesel engine air conditioning system to the vehicle cab (70), and a pre-oiler pump (83) used to pressurize lubricating oil in the main engine (8). A method of operating the overall assembly and for retrofitting an existing heavy-duty diesel engine (8) with the auxiliary power assembly (5) also are disclosed.

33 Claims, 3 Drawing Sheets

COMPACT AUXILIARY POWER SYSTEM FOR HEAVY-DUTY DIESEL ENGINES AND METHOD

RELATED APPLICATION

This application is a continuation-in-part application based upon co-pending application Ser. No. 08/203,414, filed Mar. 1, 1994, and entitled "SMALL COMPACT AUXILIARY POWER SYSTEM FOR HEAVY-DUTY DIESEL ENGINE INSTALLATIONS."

TECHNICAL FIELD

The present invention relates, in general, to auxiliary power systems for use with heavy-duty diesel engines, and more particularly, relates to compact auxiliary power systems of the type which have been employed in diesel powered trucks or the like.

BACKGROUND ART

The total fossil fuel waste, and the attendant economic loss, in connection with heavy-duty diesel engine idling in the trucking industry is staggering. The adverse effects of heavy-duty diesel engine idling are pervasive. Obviously, there is the cost of diesel fuel, but in addition, low rpm (e.g. 1,000 rpm or less) idling increases maintenance costs by operating the engine under less than optimal and relatively inefficient operating conditions. Idling requires more frequent oil changes due to oil contamination and increases engine wear.

A large or heavy-duty diesel engine will typically burn at least about one gallon of diesel fuel per hour while idling. The exact cost of the related maintenance and wear and tear on the truck engine while idling is complex to calculate and certainly very dependent upon the assumptions made in the calculation. Whatever the exact cost may total, it is estimated that six of every fourteen hours of truck operation are spent idling. Diesel trucks are often left idling for hours, for example, to power cab and sleeper air-conditioning units (HVAC) and to maintain an elevated temperature in the diesel engine block in cold climates. Large diesel engines are notoriously hard to start in cold climates once the block has been allowed to cool to ambient conditions. In fact, it is suspected that many truck drivers idle their engines even more than the trucking companies realize or the industry statistics indicate.

One approach to solving heavy-duty diesel engine idling waste has been for trucking companies to establish policies requiring engine shut-down after a predetermined amount of idling. The obvious problem with this approach is that the drivers may not follow the prescribed policy. More recently, federal regulations have been enacted which will require new diesel engines to include controllers which shut down engine operation after, for example, 5 to 10 minutes of idling. This solution also can be defeated by driver modifications to the engine controllers and/or periodic engine racing. Moreover, it will be many years before such regulations will be implemented in a majority of the trucks which are on the road. Additionally, even if diesel engines are automatically shut down, all the problems with sleeper and cab air-conditioning, as well as cold weather starting will remain.

Another approach which has been taken to the problem of heavy-duty diesel engine idling has been to provide an auxiliary engine or power unit that is used to operate the truck HVAC and to maintain the engine block temperature, for example, by circulating oil and/or water from the auxiliary power unit through the main engine block. One such system is commercially distributed under the trademark PONY PACK and is described in more detail in U.S. Pat. Nos. 4,682,649 and 4,756,359. Similar truck auxiliary power systems are also disclosed in U.S. Pat. Nos. 4,448,157, 4,531,379 and 4,611,466. In these systems, the HVAC support and engine block temperature are maintained by the auxiliary engine, which burns fuel at a much lower rate, for example, one quart per hour, as opposed to one gallon per hour. The auxiliary engine oil and/or water coolant systems are connected to the main diesel engine for the circulation of coolant and lubricant at elevated temperatures to the main diesel engine. The auxiliary power unit also powers the truck's electrical system.

While constituting a significant step forward, such prior art auxiliary power systems only partially alleviate one of the major problems in connection with heavy-duty diesel engines, namely, starting. Typically, a heavy-duty diesel engine will carry a battery pack comprised of four relatively large, lead-acid batteries that are used to crank an electric starter motor in order to start the diesel engine. Under cold conditions, starting can be very difficult and even impossible. The prior art auxiliary power systems which maintain the diesel engine block temperature at an elevated level, as compared to ambient conditions, help reduce the starting problem, but they do not eliminate it. Moreover, the auxiliary power unit adds to the overall truck weight and poses a problem in terms of finding a location on the truck cab at which the auxiliary power unit can be mounted, plumbed to the main engine and safely coupled to the exhaust assembly.

It is also well known in connection with heavy-duty diesel engines that various starting techniques can be employed. The vast majority of the trucking industry employs electrical starters driven by large lead-acid battery packs. There are truck fleets, however, which also employ air starters, but most typically these systems are used in terminal-to-terminal applications because the truck will typically carry only enough compressed air for one or two starting sequences. When a trucking fleet is run from one terminal to another, both terminals will have air compressor facilities which can be used to start the diesel engines. In many longhaul applications, facilities for air starting are not as readily available, and electrical starters are usually employed.

In the shipping industry, it is known to employ auxiliary power units to allow recharging of pressure vessels carried by the ships and used for air starting of the main engines of the ship. U.S. Pat. No. 1,618,335, for example, discloses such an auxiliary powered shipboard installation in which there are a multiplicity of air accumulators and the necessary valving to operate various systems on the main engine, including an air starter, from these air accumulators. Recharging of the air accumulators can be accomplished by either the main or auxiliary engine. In the shipping industry, however, space requirements are not critical, and the system of U.S. Pat. No. 1,618,335, for example, includes six pressure vessels in the accumulator, plus a large low pressure air storage tank.

Other examples of air starting apparatus for diesel engines can be found in U.S. Pat. Nos. 2,906,088, 3,744,602 and 4,248,190.

It is also known to employ mechanical or hydraulic clutches between auxiliary power engines and main diesel engines, which are used alone or in combination with engine block heating, to start the main diesel engine. For example, U.S. Pat. Nos. 2,557,933, 2,696,203, 2,766,749, 2,943,617, 3,156,229, 3,662,544 and 4,542,722 are directed to mechanical or hydraulically coupled auxiliary and main diesel engines.

Thus, the attempts to reduce heavy-duty diesel engine idling waste have been largely directed to solving the problem by coupling an auxiliary power unit to the main engine to augment main engine heating while using the existing or original starting equipment. The result tends to be the addition of weight and volume (the auxiliary power unit), which must be carried when the engine is driving the vehicle, and little has been done to address a major source of environmental problems in the vast majority of the heavy-duty diesel engines in use today, namely, the extensive use of heavy and environmentally polluting lead-acid batteries.

Accordingly, it is an object of the present invention to provide a compact auxiliary power system for heavy-duty diesel engines and a method which will enable the realization of substantial fuel savings during idling without significant weight or volume increase which reduces running efficiency.

Another object of the present invention is to provide a compact auxiliary power system and method which can be retrofit to existing heavy-duty diesel engines to effect substantial fuel savings and to significantly reduce the negative environmental impact of lead-acid batteries which are typically used to start such engines.

A further object of the present invention is to provide an auxiliary power system for use with heavy-duty diesel engines which is inexpensive to retrofit to existing engines, which can be installed in the place of a conventional engine starter battery pack without the use of significant additional space, which is durable and reliable in its operation, and which has less adverse environmental impact than a conventional heavy-duty diesel engine.

DISCLOSURE OF INVENTION

The present invention allows a heavy-duty diesel engine of the type in widespread use in the trucking industry to be augmented with a small, compact auxiliary diesel power system. The auxiliary power system enables the heavy-duty diesel engine to be started with an air starter and permits the conventional electric starter battery pack, usually consisting of four large lead-acid batteries and related hardware, to be eliminated and replaced by the present auxiliary diesel-power system. Briefly, the compact auxiliary power system of the present invention is comprised of an internal combustion engine, preferably a diesel engine, which is coupled to drive a pneumatic assembly, preferably an air compressor which is fluid coupled to a compressed air reservoir, and most preferably an accumulator. The pneumatic assembly is formed for fluid coupling to a pneumatic starter which is mounted to the diesel engine in the place of a conventional electric starter. The overall size of the auxiliary diesel engine and air compressor is not substantially greater than a four-battery pack of the type used to drive a conventional diesel engine electric starter.

In another aspect of the present invention, a method is provided for augmenting a heavy-duty diesel engine with an independently operable auxiliary power system which is comprised, briefly, of the steps of coupling a pneumatic starter to the heavy-duty diesel engine; mounting an auxiliary power system including an independently operable engine, such as a small, compact diesel engine and a pneumatic compressor assembly coupled to be driven by the independent engine; and connecting the pneumatic assembly of the auxiliary power system to the pneumatic starter coupled to the heavy-duty diesel engine. In the preferred form, the method of the present invention is employed to retrofit the auxiliary power system to an existing heavy-duty diesel engine assembly of the type commonly employed in the trucking industry, and the present method includes the further steps of removing an electric starter mounted to the heavy-duty diesel engine prior to coupling the pneumatic starter to the heavy-duty diesel engine; and removing an electrical battery pack connected to the electric starter prior to the mounting step so that an auxiliary power system having a size not substantially greater than the electrical battery pack can be mounted in the space formerly occupied by the battery pack.

In the most preferred form, the auxiliary power system of the present invention further has the lubricating system, an electrical system and a fluid coolant system which are coupled to the corresponding lubricating system, electrical system and fluid coolant system of the main heavy-duty diesel engine. This allows the auxiliary power system to maintain operating temperatures in the heavy-duty diesel engine, as well as to operate the HVAC system and electrical apparatus for the truck cab and sleeper compartments while the main heavy-duty diesel engine is shut down. The auxiliary power system of the present invention also provides a redundancy as to the air, electrical and HVAC systems of the truck.

BRIEF DESCRIPTION OF THE DRAWINGS

The FIGURE is a schematic illustration of a the compact, auxiliary power system for a heavy-duty diesel engine constructed in accordance with the present invention.

BEST MODE OF CARRYING OUT THE INVENTION

Figure 1A:
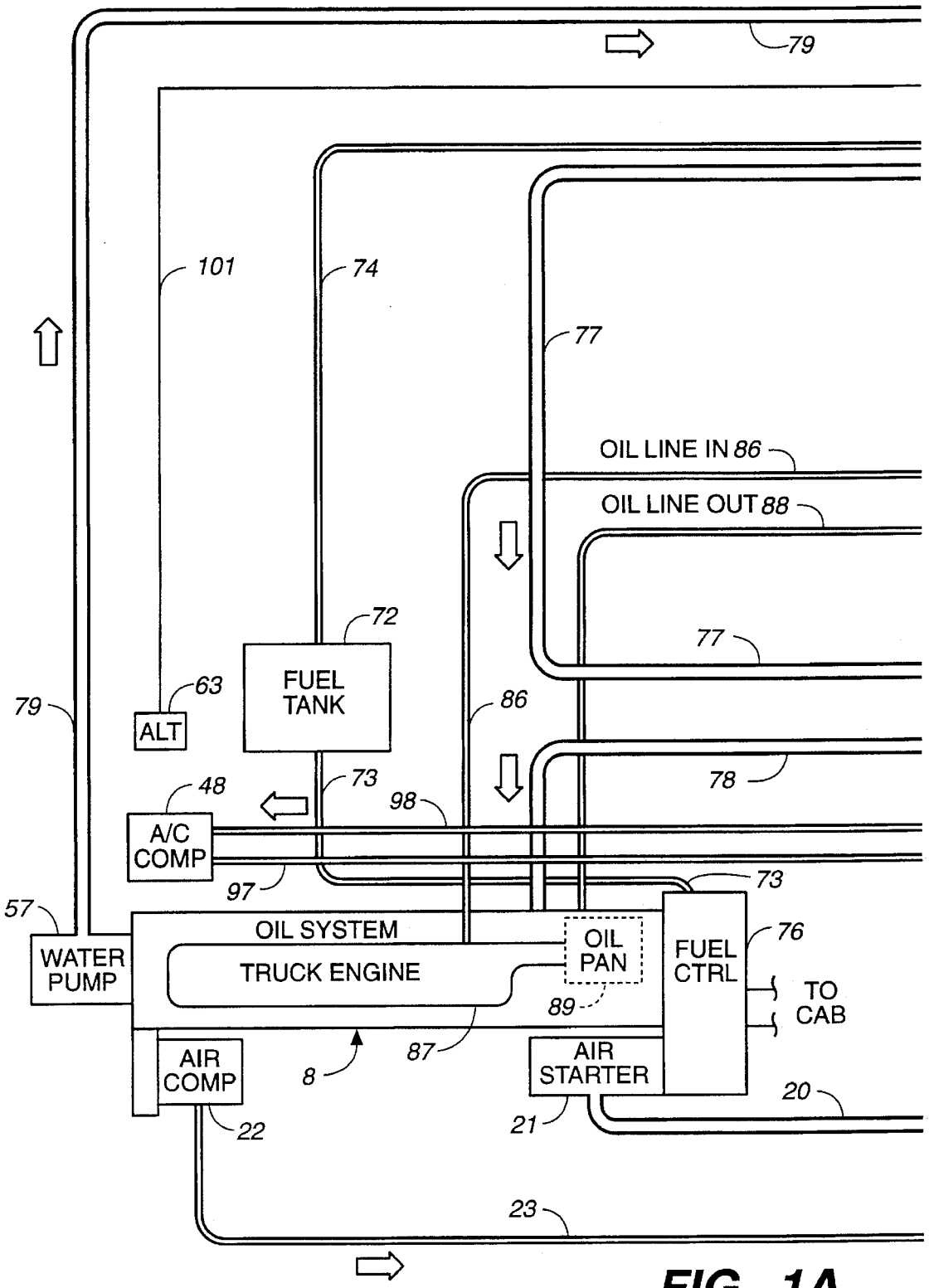
Figure 1:
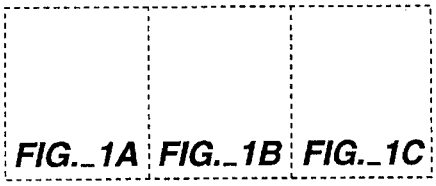
Figure 1B:
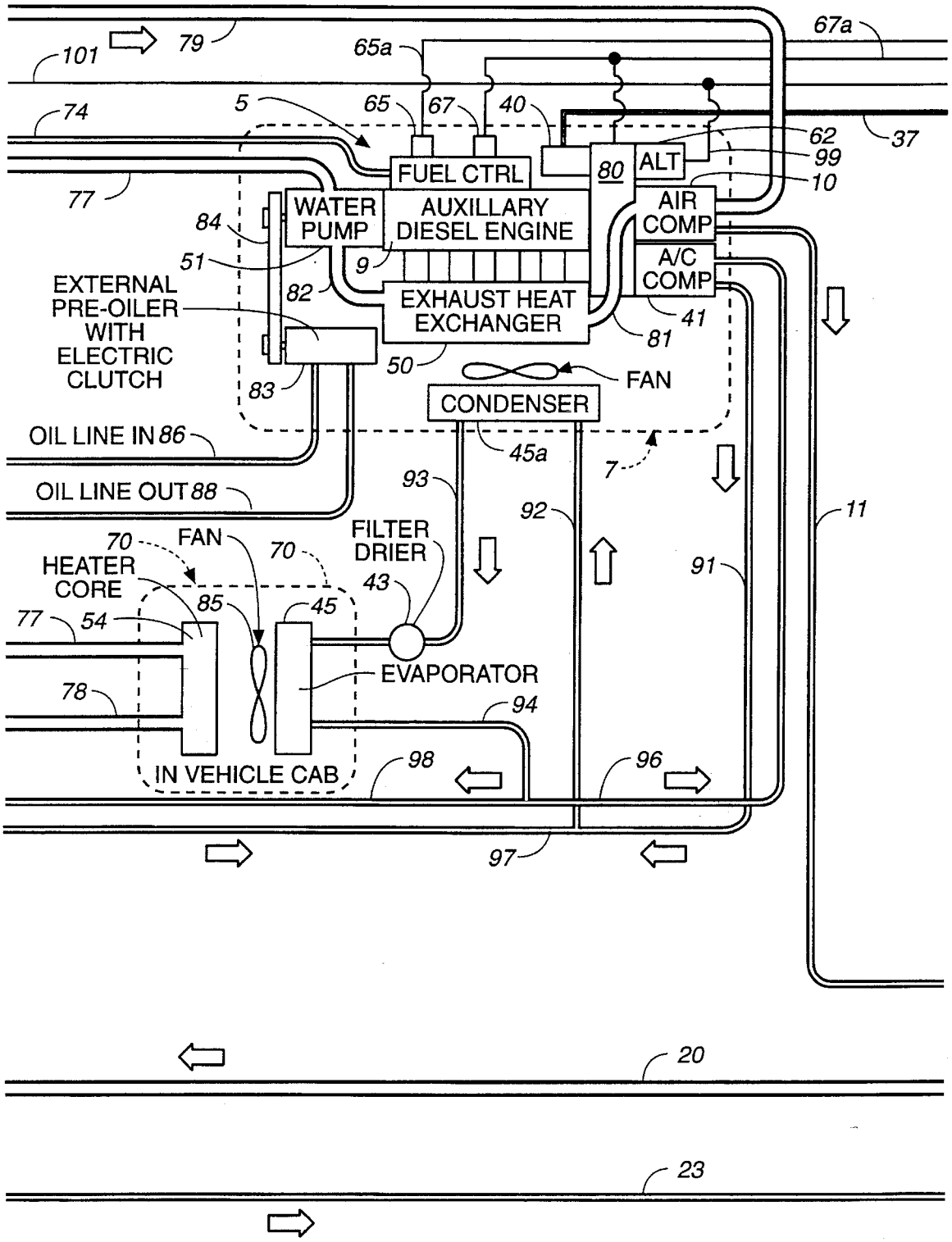
Figure 1C:
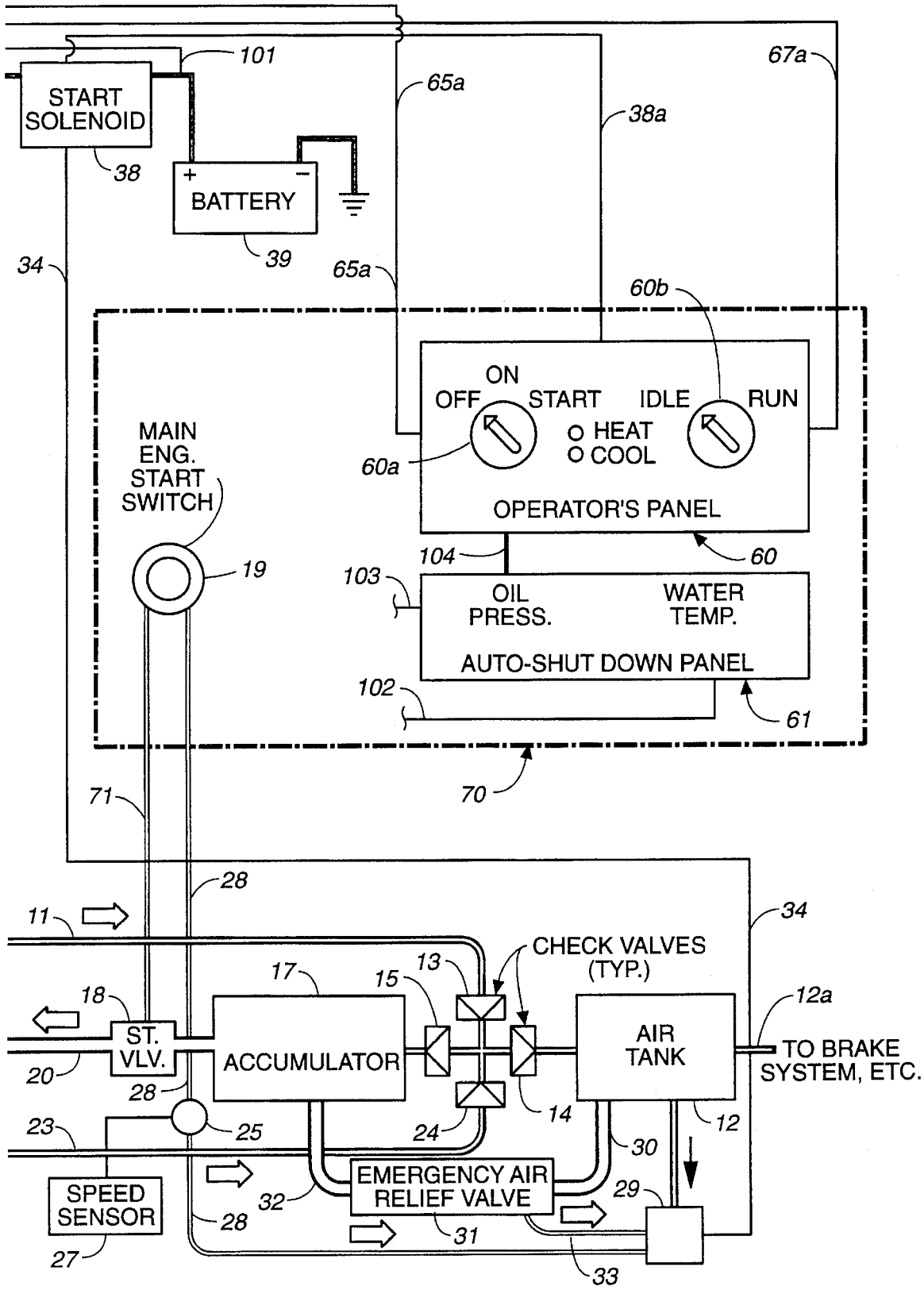

An auxiliary, small, compact power system, generally designated 5, is dimensioned to fit within the confines of a space provided by means, generally designated 7, for accommodating conventional apparatus, such as a battery pack (not shown). Means 7 is typically provided by a framework or shelf dimensioned to receive four large lead-acid batteries of the type customarily employed to drive an electric starter of the type employed on a large, heavy-duty, main diesel engine, generally designated 8. Such heavy-duty diesel engines are of the kind used for powering large vehicles, for example, over-the-road truck/tractors, military tanks, and heavy road equipment, such as tractors, loaders and graders, etc.

In a typical truck installation, battery pack supporting framework will be provided somewhere on the tractor frame, for example, by a shelf or framework positioned under the step structure used by the driver to enter the cab. The four lead-acid batteries employed must be of substantial size because of the considerable power required to drive the electric starter at a rate and for duration sufficient to start heavy-duty diesel engine 8. For example, framework or space 7 might typically have a volume of about 4 to 6 cubic feet, and the weight of the batteries and related hardware installed on framework 7 might typically be about 250 pounds.

It is an important feature of the present invention that auxiliary power system 5 can be positioned in the space provided by framework 7 instead of being an "add-on"

system which increases the overall weight and space requirements for the heavy-duty vehicle or equipment. The auxiliary power system of the present invention, as will be set forth in more detail below, provides the distinct advantage of simply displacing and substituting for eliminated conventional apparatus without adding any significant weight or requiring any significant new space. In the trucking industry, this approach results in a payload economy advantage.

It is contemplated and advantageous to use the auxiliary power system of the present invention as original equipment, in which case auxiliary power assembly 5 of the present invention is merely placed on platform 7, which would conventionally be occupied by a battery pack. It is particularly advantageous, however, that auxiliary power system 5 of the present invention may be employed to retrofit existing trucks. Whether provided as original equipment or retrofit, the present system effects substantial savings in main engine idling costs without increase the weight or volume required to be transported when the vehicle is moving.

A primary component of auxiliary power system 5 is an auxiliary engine, preferably a small diesel engine 9, which drives a pneumatic means for creating and storing pneumatic energy in the form of a compressed gas. In the preferred form, auxiliary diesel engine 9, such as a Kubota model D722E, drives an air compressor 10 through an electric clutch 80, which is coupled by a fluid conduit 11 to a compressed air reservoir 12 through check valves 13 and 14. In the preferred form, air tank 12 can be the existing air brake tank conventionally forming a part of the vehicle's pneumatic system, for example, the compressed air reservoir used to power the vehicle's air brakes. The tank 12 can be coupled to a pneumatic conduit 12*a* which communicates compressed air to the vehicle's brake system and/or other pneumatically powered devices.

It is further preferable, however, that auxiliary power system 5 of the present invention be coupled to an additional pneumatic storage device, namely, a compressed air start tank, most preferably an accumulator 17 through check valves 13 and 15. Thus, air compressor 10, which may be a Bendix Tu-Flo 501, provides compressed air to the truck's air tank 12 and to accumulator 17. Most preferably an air drier and manifold (not shown) are positioned between check valve 13 and tank 12 and accumulator 17. The air drier or tank 12 can have a pressure sensor (not shown) which starts compressor 10 if the pressure falls below a threshold, for example 90 psi. When compressor 10 operates, it automatically switches off the pre-oiler pump 83 and the air conditioning compressor 41.

Accumulator 17 functions as a start tank, in a manner which will be described below, and it is formed with a movable piston (not shown) which ensures that delivered to starter 21 is delivered at a substantially constant output pressure over substantially the full volume of tank 17. Air compressor 10 will typically have an output pressure to conduit 11 of on the order of about 90–120 pounds per square inch, which is delivered to both tank 12 and accumulator 17. Accumulators of the type suitable for use in the present invention are well-known in the pneumatic industry. The present invention will work equally well using a storage tank at reservoir 17, but an accumulator is smaller in size and weight than a conventional storage tank.

Accumulator 17 is not normally part of the original equipment of the vehicle and must be added with auxiliary power assembly 5 of the present invention. Accumulators, however, have a relatively small volume, for example, 1–2 cubic feet, and can be easily bracket-mounted to many locations on the cab or framework of the cab, without significantly adding to the overall volume or weight of the assembly of the present invention.

An important aspect of the present invention is that instead of merely providing an auxiliary power assembly, which merely elevates the temperature of the water and oil in the main diesel engine, the auxiliary power unit of the present invention converts what would normally be an electrically started diesel engine into a pneumatically started diesel engine. This selection, in the original equipment case, and conversion, in the retrofit application, results in substantial economic benefits. It enables pneumatic starting of the diesel engine without having to employ the vehicle only in short-haul applications in which each terminal has its own pneumatic starting facilities. Moreover and very importantly, it allows the conventional electric starting equipment to be removed, or not employed, in starting main diesel engine 8. This results in a substantial reduction in the use of lead-acid batteries, which are environmentally highly undesirable, and allows auxiliary power assembly 5 to be added without significantly adding to the overall vehicle weight or space.

In a retrofit application, the electric starter (not shown) is removed, and in the original equipment application, the electric starter simply is not installed. Instead, a pneumatic or air starter 21, such as a Rockwell air starter, is mounted to drive main diesel engine 8 in place of, or instead of, an electric starter, and air starter 21 is coupled by pneumatic conduit 20 through start control valve 18 to accumulator 17. Operation of starter 21 can be controlled by a starter switch 19 located in the cab 70 of the vehicle through pneumatic control conduit 71, which receives air from the accumulator and is used to switch or change the state of valve 18 when switch 19 is depressed.

In the usual installation, main diesel engine 8 will also drive an air compressor 22 which is connected by conduit 23 and check valve 24 to both air tank 12 and accumulator 17. Thus, when auxiliary engine 9 is operated, both the accumulator 17 and air tank 12 are replenished by compressor 10, while when main engine 8 is operated, the accumulator and air tank 12 are replenished by compressor 22.

In order to provide further safety, the present integrated pneumatic system can also include a control valve 25 mounted in air conduit 28, which is coupled to receive air from accumulator 17. A speed sensor 27, such as the speedometer, is used to open valve 25 when the truck is moving. This causes the accumulator pressure, for example, 90 to 120 psi, to be communicated to a pressure sensor 29 provided in line 28 so as to provide pneumatic pressure for operation of valve 31. Sensor 29 also is connected by a conduit 30 to sense pressure in air reservoir or tank 12. An emergency air supply valve 31 is mounted in a pneumatic conduit 32 extending between and coupling accumulator 17 to air reservoir 12. Air pressure control duct 33 is used to actuate emergency supply valve 31 and extends to pressure sensor 29.

When the truck or vehicle is moving, speed sensor 27 opens valve 25 and pressure sensor 29 senses the pressure in tank 12, the reservoir used for braking. If the pressure in tank 12 falls below a safe level, for example, 80 psi, the sensor 29 will communicate pressure from accumulator 17 through conduits 28 and 33 and through valve 29 to emergency air valve 31 opening the valve. This dumps air from accumulator 17 into tank 12.

Since the vehicle is moving, there is no need to retain air in the accumulator.

Simultaneously, an electric signal is communicated by conductor means 34 from sensor 29 to start solenoid 38, and the auxiliary engine is automatically started. A pressure sensor (not shown) senses a rise in the oil pressure in auxiliary engine 9 and may be used to interrupt the signal in conductor 34 from sensor 29 if the auxiliary engine is already running (as well as disabling start solenoid 38 once engine 9 is started from the cab).

Thus, both compressor 22 on main engine 8 and compressor 10 on auxiliary engine 9 may be simultaneously used to supply air tank 12 in the event of a leaking pneumatic system on the truck. This integration of the pneumatic systems provides redundancy and enhanced safety for the vehicle.

When the truck is stopped, speed sensor 27 close valve 25. This prevents auto-starts when not required.

In the most preferred form of the system of the present invention, it is further desirable to elevate the temperature of the main engine block and particularly the coolant system and lubrication system of main diesel engine 8. Moreover, in the preferred version auxiliary engine 9 is a diesel engine and may conveniently be coupled to and use diesel fuel from the fuel tank 72 by fuel conduit 74. Fuel is supplied to main engine 8 through fuel conduit 73 and a conventional fuel control assembly 76, which is coupled for in-cab control of main diesel engine 8 and will not be described in more detail herein.

Coupling of the auxiliary engine coolant system to that of the main engine is preferably accomplished by connecting the output of auxiliary water pump 51 to conduit 77, which extends to a heater core 54 located inside vehicle cab 70. Thereafter, coolant is pumped by pump 51 through conduit 78 to the conventional diesel engine coolant system. Water pump 57 is mounted on the coolant system of main engine 8 and has an outlet conduit 79 which returns coolant back to the auxiliary engine 9. When the main diesel engine 8 is shut down, in a manner which will be described in more detail below, auxiliary pump 51 merely pumps coolant through the coolant system of the main engine and through water pump 57 so as to return the coolant through conduit 79 back to the auxiliary engine.

As can be seen, return of coolant through conduit 79 is passed through a water jacket or head on air compressor assembly 10 in order to cool the air compressor.

A conduit 81 couples the air compressor head to exhaust heat exchanger 50 of the auxiliary diesel engine, which in turn is connected by conduit 82 to the auxiliary engine water pump 51.

It is further preferable to use auxiliary power system 5 to maintain the pressure of the lubricant in the main diesel engine oil system. This is accomplished in the present invention by providing an external pre-oiler pump and electric clutch assembly 83, such as a Weaber Brothers pre-oiler, Model P9136, which is driven by belt 84. Conduit 88 is coupled between the truck engine oil system 87 and pre-oiler 83 so that oil can be drawn from main engine oil pan 89 to the pre-oiler and then returned to conduit 86 to oil system 87 on the main diesel engine. Thus, in the preferred form, the main engine oil system remains isolated from the oil system for auxiliary engine 9, but is maintained under pressure so as to lubricate the main engine using power provided by the auxiliary engine. Some heating of the lubricant also is accomplished as a result of pressurizing the lubricant and passage of the oil through the oil/coolant heat exchanger on the main engine, which is at an elevated temperature as a result of pumping coolant from the auxiliary engine to the main engine.

Auxiliary power system 5 also has the capability of maintaining a comfortable environment for the occupants of the vehicle during extended periods of time when main engine 8 is shut down. Thus, as above described, auxiliary engine coolant is pumped through an in-cab heater core 54. (In many installations, a sleeper heater core also is mounted in series with cab core 54.) When heating is desired, fan 85 is operated. The same fan, with appropriate and convention dampering, is used with air conditioning evaporator 45 for cooling. An air conditioner compressor and clutch assembly 41, such as a Sanden International model SD508 compressor, can be provided and driven by auxiliary engine 9. Compressor 41 compresses and pumps a refrigerant fluid, such as freon CFC (now replaced in the industry by a non-CFC refrigerant, such as refrigerant 134) through conduit 91. The compressed fluid then passes through branch conduit 92 to condenser **45*a* provided in auxiliary power system assembly 5. A conduit 93 communicates the refrigerant through filter dryer 43 to an evaporator or coil 45 positioned inside cab 70 for the purpose of cooling of the cab. A return branch conduit 94 passes from the evaporator coil to a main return conduit 96, which is coupled to air conditioner compressor 41**.

This air conditioning system is also coupled to the main diesel engine 8 in the following manner. Main air conditioning compressor 48 is driven by main diesel engine 8 and coupled by outlet conduit 97 to branch conduit 92 to condenser 45. The return of refrigerant comes from conduit 98 which is coupled to the branch conduit 94 from the evaporator and returns to main engine air conditioner compressor 48. In the system when one of the two engines is shut down, the other drives the refrigerant through evaporator coil 45 so that air conditioning of cab 70 can be accomplished when either engine is operated.

The auxiliary power system of the present invention further includes certain in-cab controls. A small operator's panel 60 may be conveniently located in a panel area of cab 70 to facilitate access to controls for the auxiliary power system. A three-way on/off switch **60*a* controls auxiliary engine 9 through electrical conductor means 38*a* to starter solenoid 38. A second electrical conductor means 65*a* leads from switch 60*a* to fuel shut-down solenoid 65, while a third electrical conductor means 67*a* extends from an idle/run switch 60*b* to a throttle solenoid 67 provided on a fuel controller for auxiliary engine 9. These controls are all powered by battery 39**, which can be a relatively small lead-acid storage battery of the type found in a conventional automobile.

Auxiliary power assembly 5 also will include an alternator 62 mechanically coupled to be driven by auxiliary diesel engine 9 and coupled by electrical conductor means 99 and 101 to battery 39 for recharging of the same. Conductor means 101 is also coupled to an alternator 63 driven by main diesel engine 8 so that operation of either the main or auxiliary engines will effect recharging of battery 39.

Monitoring of the oil and coolant temperatures in auxiliary engine 9 can be accomplished at display panel 61, which is coupled by conductor means 102 and 103 to temperature sensors (not shown) for the oil and water systems of the auxiliary diesel engine. The sensing panel 61 can be further coupled by conductor means 104 to operator's panel 106, and particularly the shut-down solenoid controlled by panel 60, so that an automatic shut down of the auxiliary diesel engine will result in the event that the oil or water temperatures exceed predetermined thresholds. The operation of HVAC systems in the vehicle cab are controlled by heat and air conditioning controls of the type normally installed in the cab of the vehicle with such systems.

Having described the preferred apparatus of the auxiliary and power system of the present invention and the heavy-duty diesel engine apparatus which the auxiliary system augments, operation of auxiliary power system 5 can now be described in detail.

The primary purpose of auxiliary power system 5 is to enable the vehicle operator to shut down main diesel engine 8 in situations in which it would be left on in an idling mode. The present apparatus and method enable elevated oil and water temperatures to be maintained in the main diesel engine for easy starting, and enable operation of the HVAC system in the cab and the pneumatic brake system. By using a pneumatic-based starting system, the auxiliary power system of the present invention allows the elimination of large lead-acid starter batteries for the main diesel engine and allows the mounting of substantially all of the auxiliary power system in the space once occupied, or planned to be occupied, by the lead-acid diesel starter batteries.

The heavy-duty main diesel engine 8 can be shut down when the vehicle or heavy equipment which it is driving is out of service or not to be driven, even for a short period of time. The auxiliary power system effects a substantial savings in fuel, a reduction of air pollution and a reduction of maintenance and repair costs for the main engine.

Once the main engine is shut down, start switch 60*a* will be switched to the "on" position and then advanced against a spring bias to the "start" position, which activates starter solenoid 38. The starter solenoid in turn actuates electrical starter motor 40 to start the auxiliary diesel engine 9. Switch 60*b* will be switched to the "idle" mode during the starting process. Once the auxiliary engine is running, switch 60*b* can be switched to "run" opening throttle solenoid 67 further and engaging electric clutch 80 to start compressor 10 and alternator 62. Compressor 10 will pump compressed air to both air storage tank 12 and accumulator 17 so as to replenish the air pressure in both reservoirs, to the extent they were not already at a full desired pressure. Water pump 51 of the auxiliary diesel engine will pump coolant through heater core 54 in the cab, if heating is required, fan 85 will be switched to "on." Pump 51 pumps the coolant through heater core 54 to the coolant system for the main diesel engine 8. Return of fluid occurs through the water pump 57 and return conduit 79.

Operation of the auxiliary diesel engine similarly causes the air conditioned compressor 41 to operate and drives pre-oiler pump 83 so as to pressurize the oil in the main engine lubricating system 87. Freon or a similar refrigerant is pumped through the air conditioning system and evaporator 45 for cooling of cab 70, if cooling is required.

The auxiliary diesel engine will continue in the run mode and because of the auxiliary engine's small size, for example, about 15–20 horsepower, engine 9 can drive the respective pumps and compressors at a fuel consumption rate of approximately one quarter of fuel hour, instead of one gallon of fuel per hour, which is typical fuel consumption rate for idling of diesel engine 8.

When main engine 8 is to be started, auxiliary engine 9 can be either shut down by switch 60*a*, switched to an "idle" mode by switch 60*b* or left in the "run" mode. In most cases, the auxiliary engine will be left in the "run" mode until the main engine is started. Engine 9 may be shut down, however, by first turning switch 60*b* to "idle" to throttle-down the engine and thereafter switching switch 60*a* to "off" which shuts off fuel using solenoid 65.

To start the main engine, the operator presses main engine start switch, which pneumatically opens the start valve 18 from accumulator 17 to allow the high pressure compressed air stored in accumulator 17 to drive pneumatic starter 21. Since the water and coolant temperatures in main engine should be elevated, starting of the main engine through air starter 21 should be accomplished relatively easily. If, however, for some reason such as extremely cold temperatures, the main engine cannot be started, the starter switch 19 can be released (it is pressure based to an open position), and auxiliary engine switched, if left in the "run" mode, will recharge accumulator 17. With the auxiliary engine-operated air compressor 10 constantly available and integrated into the air system of the main engine 18, repeated start attempts are possible. Accumulator 17 can be relatively rapidly recharged by air compressor 10, for example, in less than about 2 minutes.

The present invention also provides pneumatic redundancy, for example, by providing pneumatic replenishment of reserve reservoir tank 12 for the brake system of the vehicle and emergency dumping of compressed air into tank 12 from tank 17, if there is a pressure drop in the vehicle brake system during running of the vehicle, as described above.

From the description of the present apparatus, it will be apparent that the method of the present invention is particularly suitable for retrofitting to vehicles having existing electric starting systems. The present method includes the steps of removing the battery pack from the framework or space 7 in which it is mounted, installing an auxiliary power unit 5 in such space, and connecting an air supply assembly of the auxiliary power unit to a pneumatic starting assembly for the heavy-duty diesel engine. The step of connecting the pneumatic starting assembly may be accomplished by removing the electric starter from main diesel engine 8, and mounting a pneumatic starter to engine 8, which preferably is coupled to a pneumatic reservoir 17, such as an accumulator, that is fluid coupled to compressor 10 on the auxiliary power unit 5.

Additionally, the present method preferably includes the steps of coupling an oil pump 83 to pressurize the main engine oil using the auxiliary engine 9, coupling the auxiliary engine coolant system to the main engine coolant system, coupling the auxiliary engine to drive the air conditioning system driven by the main engine, and coupling the auxiliary engine 9 to receive fuel from fuel tank 72 for the main engine. Finally, in the preferred method the pneumatic system of the auxiliary engine is integrated with that of the main engine to provide pneumatic redundancy.

What is claimed is:

1. In combination with a heavy-duty diesel engine installation:

a space equivalent to four diesel engine batteries;

a small compact auxiliary power system occupying said space; and pneumatic means for creating and storing pneumatic energy in a compressed gas to start the diesel engine, said means receiving energy from said auxiliary power system.

2. A combination as defined in claim 1 wherein, said auxiliary power system comprises a small diesel engine and operating equipment therefor.

3. A combination according to claim 1, including an air reservoir, and air compressor means operated by said auxiliary power system for pneumatically loading said air reservoir.

4. A combination according to claim 3, including air compressor means operated by said heavy duty diesel engine installation for maintaining the air pressure in said storage means when the heavy-duty diesel engine is operating.

5. A combination according to claim 1, including means operated by said auxiliary power system for air conditioning fluid and coolant fluid circulation purposes.

6. A combination according to claim 1, including heat exchanger means of said auxiliary power system integrated with a coolant system of said heavy-duty engine, and air-conditioning system having air-conditioner compressors operated by respectively said heavy-duty diesel engine and said auxiliary power system.

7. A combination according to claim 1 wherein, said means receiving energy from said auxiliary power system is a compressed gas accumulator fluid connected to a pneumatic starter formed for mounting on and starting of said heavy-duty diesel engine.

8. In combination with a heavy-duty diesel engine installation:

means providing a conventional apparatus-receiving space associated with such installation;

a small compact auxiliary power system occupying said space instead of said conventional apparatus;

a pneumatic assembly cooperatively connecting said auxiliary power system with said heavy-duty diesel engine installation; and wherein said auxiliary power system comprises a small diesel engine and operating equipment therefor, a compressor operated by said small diesel engine, and air storage reservoir supplied by said compressor.

9. A combination according to claim 8, wherein said heavy-duty diesel engine installation has an air starter, said air storage reservoir comprising a start tank for supplying air under pressure to said air starter, and an air reservoir comprising a brake tank connected with said start tank.

10. A combination according to claim 9, including a valve assembly for maintaining air pressure in said brake tank above a predetermined threshold by dumping air pressure from said start tank to said brake tank.

11. A combination according to claim 8, wherein, said means providing a conventional apparatus-receiving space is provided by a framework dimensioned to receive and support an assembly of lead-acid storage batteries.

12. A combination according to claim 11 wherein, said framework is dimensioned to receive and support at least four lead-acid storage batteries of a size sufficient to start said heavy-duty diesel engine.

13. An auxiliary power assembly for use with a heavy-duty diesel engine comprising:

a small, auxiliary, internal combustion engine;

an air compressor coupled to and driven by said internal combustion engine;

a compressed air reservoir adapted to be mounted proximate said internal combustion engine and coupled to said air compressor for fluid communication therewith;

said small auxiliary engine and said air compressor having a combined volume not substantially greater than the combined volume of a battery pack for said heavy-duty diesel engine; and a pneumatic starter adapted to be mounted on and for starting said heavy-duty diesel engine and coupled to said air reservoir to receive compressed air from said air reservoir and said air compressor.

14. The auxiliary power assembly as defined in claim 13 wherein, said small, auxiliary, internal combustion engine further is coupled to drive an oil lubrication pump formed for fluid coupling to an oil lubrication system of said heavy-duty diesel engine.

15. The auxiliary power assembly as defined in claim 13 wherein, said small, auxiliary, internal combustion engine includes a liquid coolant pump formed for fluid coupling to a liquid coolant system of said heavy-duty diesel engine.

16. The auxiliary power assembly as defined in claim 13 wherein, said small, auxiliary, internal combustion engine is an auxiliary diesel engine and said auxiliary diesel engine is formed for fluid coupling to a fuel supply for said heavy-duty diesel engine.

17. The auxiliary power assembly as defined in claim 13 wherein, said compressed air reservoir is provided by an accumulator.

18. The auxiliary power assembly as defined in claim 13 wherein, said compressed air reservoir is a start tank formed for fluid coupling to a main air compressor driven by said heavy-duty diesel engine.

19. The auxiliary power assembly as defined in claim 18, and a brake tank air reservoir fluid coupled to receive compressed air from said main air compressor and from said air compressor coupled to said auxiliary, internal combustion engine.

20. The auxiliary power assembly as defined in claim 19, and a pressure sensor coupled to sense pressure in said start tank and said brake tank, a speed sensor positioned to sense a speed of a vehicle in which said main engine is mounted;

a valve assembly coupled to said pressure sensor and said speed sensor and responsive to both of a sensed pressure below a predetermined threshold in said brake tank and a sensed vehicle speed, to communicate pressure in said start tank to said brake tank.

21. The auxiliary power assembly as defined in claim 20, and an automated start assembly coupled to said auxiliary engine to start said auxiliary engine when said valve assembly communicates pressure from said start tank to said brake tank.

22. A method of operating a heavy-duty diesel engine installation in a vehicle having a battery pack and a framework providing a battery pack space, comprising:

removing said battery pack from said space; and installing in said space an auxiliary power unit, and connecting said auxiliary power unit and said heavy-duty diesel engine through an air supply system coupled to pneumatic starting assembly for said heavy-duty diesel engine.

23. A method according to claim 22 wherein, said pneumatic starting assembly comprises an air reservoir tank and a starting supply tank and said air supply system comprises an air compressor and said method comprises the step of pneumatically loading said air reservoir tank and said starting supply tank with said air compressor.

24. A method according to claim 22 which includes operating air-conditioning and coolant circulation systems by running said auxiliary power unit.

25. A method of retrofitting a heavy-duty diesel engine with an auxiliary power assembly, said heavy-duty diesel engine having an electric starter operably coupled to start said heavy-duty diesel engine and a battery assembly mounted in a space proximate said heavy duty diesel engine and electrically connected to said electric starter, said method comprised of the steps of:

removing said electric starter from said heavy-duty diesel engine;

removing said battery assembly from said space;

coupling a pneumatic starter to said heavy-duty diesel engine;

mounting an auxiliary power assembly including an independently operable auxiliary internal combustion engine coupled to drive a compressed gas generation assembly in said space, said auxiliary power assembly having an overall size not substantially greater than said battery assembly; and connecting said compressed gas generation assembly to said pneumatic starter for use in starting said heavy-duty diesel engine.

26. The method as defined in claim 25 wherein, said mounting step is accomplished by mounting an auxiliary power assembly in said space which is comprised of an auxiliary internal combustion engine coupled to drive an air compressor; and said connecting step is accomplished by connecting said air compressor for communication of compressed air to an air storage reservoir fluid coupled to said pneumatic starter.

27. The method as defined in claim 26 wherein, said mounting step is accomplished by mounting an auxiliary internal combustion engine in said space which is an auxiliary diesel engine, and the step of:

coupling said auxiliary diesel engine to receive fuel from a fuel source for said heavy-duty diesel engine.

28. The method as defined in claim 26 wherein, said mounting step is accomplished by mounting an auxiliary power assembly and an oil pump in said space, and the step of:

connecting said oil pump to pressurize oil in said heavy-duty diesel engine.

29. The method as defined in claim 28 wherein, said mounting step is accomplished by mounting an auxiliary power assembly including a coolant pump in said space, and the step of:

connecting said coolant pump to pump coolant from a coolant system for said auxiliary internal combustion engine to a coolant system for said heavy-duty diesel engine and to pump coolant from said coolant system for said heavy-duty diesel engine to said auxiliary internal combustion engine.

30. The method as defined in claim 26 wherein, said mounting step is accomplished by mounting an auxiliary power assembly including a coolant pump in said space, and the step of:

connecting said coolant pump to pump coolant from a coolant system for said auxiliary internal combustion engine to a coolant system for said heavy-duty diesel engine and to pump coolant from said coolant system for said heavy-duty diesel engine to said auxiliary internal combustion engine.

31. A method of providing an auxiliary power assembly for a truck powered by a heavy-duty diesel engine comprising the steps of:

coupling a pneumatic starter to said diesel engine;

mounting an auxiliary power assembly including an independently operable auxiliary engine coupled to drive a compressed gas generation assembly in said truck in a space not substantially greater than the space occupied by a conventional battery assembly for an electric starter for said diesel engine; and connecting said compressed gas generation assembly to said pneumatic starter for use in starting said diesel engine.

32. The method as defined in claim 31, and during said mounting step, coupling a coolant system for said auxiliary engine to a coolant system for said diesel engine, coupling an oil pump driven by said auxiliary engine to an oil lubricating system for said diesel engine for maintaining pressure of oil in said auxiliary diesel engine, and coupling a refrigerant compressor and pump driven by said auxiliary engine to a refrigerant system for said diesel engine.

33. The method as defined in claim 31 and the step of:

coupling said compressed gas generation assembly to provide compressed gas to a pneumatic system driven by said diesel engine.

* * * * *